United States Patent [19]

Hardouin et al.

[11] 4,168,021

[45] Sep. 18, 1979

[54] CONSTANT FLOW AEROSOL CONTAINER

[75] Inventors: Yves Hardouin, Survilliers; Robert Sathicq, Villepinte; Pierre Meurice, L'Isle Adam, all of France

[73] Assignee: L'Oreal, Paris, France

[21] Appl. No.: 813,457

[22] Filed: Jul. 7, 1977

[30] Foreign Application Priority Data

Aug. 6, 1976 [FR] France ..... 76 24207

[51] Int. Cl.[2] ..... B65D 23/14

[52] U.S. Cl. ..... 222/394; 222/464

[58] Field of Search ..... 222/464, 394

[56] References Cited

U.S. PATENT DOCUMENTS 3,260,421 7/1966 Rabussier ..... 222/464 X 3,307,751 3/1967 Kraft ..... 222/464

3,618,822 11/1971 Hildebrandt ..... 222/464 X

FOREIGN PATENT DOCUMENTS 258883 4/1963 Australia ..... 222/464

*Primary Examiner*—David A. Scherbel

*Assistant Examiner*—Frederick R. Handren

*Attorney, Agent, or Firm*—Brisebois & Kruger

[57] ABSTRACT

A substantially constant flow aerosol container having a dispensing valve provided in its inlet with a tube having a flow passage between 0.1 mm and 0.5 mm, and of a length sufficient so that flow occurs at a REYNOLDS number less than 3000. The propellant is a non-liquified gas.

6 Claims, 3 Drawing Figures

CONSTANT FLOW AEROSOL CONTAINER

SUMMARY OF THE INVENTION

It is known that numerous liquid products are conditioned or packaged in pressurized containers of the "aerosol bomb" type which permits their dispensing under pressure in aerosol form or as a liquid jet. It is also known that, if a non-liquified gas is used as a pressurizing gas or propellant, in the course of dispensing there is a pressure drop which causes a decrease in flow of the dispensed product between the beginning of and the end of emptying of the container. This lack of uniformity in the dispensing characteristics is an annoying phenomenon in numerous cases and, in particular, where cosmetic products are dispensed.

The present invention, consequently, proposes a pressurized container, which yields an essentially constant flow of the dispensed product for a full container as well as an almost empty container. According to the invention, to obtain this result, a zone is created upstream of the dispensing valve in which the normal rate of flow of the product to be dispensed is a non-turbulent flow, that is to say a laminar flow, or flow at a rate between laminar flow and turbulent flow. In this zone of the dispensing valve, the REYNOLDS number is less than 3000, and the flow is essentially constant during the dispensing of the entire contents from the aerosol container.

It is suitable to note that if a conventional type valve equipped with a conventional type pushbutton is used and if one attaches to the inlet of this valve a section of tubing in which the flow is laminar, the flow from the valve thus equipped is much lower than the normal flow from the valve. This characteristic is particularly interesting in the case where the standard type valves assure the dispensing of a pressurized product by means of a liquified propulsive gas such as a chlorofluoralcanes and where one wishes to stop using this type of propellant and adopt a non-liquified or non-liquifiable propellant. In effect, where one encounters a liquified propellant, the dispensing phase contains a large quantity of propellant and a small quantity of active product, for example, three parts propellant to one part of active product. If the propellant no longer forms a part of the liquid dispensing phase, it is necessary to obtain the same flow of active product, to decrease the flow from the valve by a factor of 4 (i.e., divide the rate of flow by 4). As a result the pressurized container according to the invention permits, because of the reduction of flow that can be obtained, replacing a burdensome and polluting liquified propellant with an inexpensive and non-polluting, non-liquified propellant, without changing the type of dispensing valve. It is sufficient, according to the invention, to fit to the valve a tubing section in which the normal rate of flow is not turbulent.

A valve is described in French Pat. No. 2,090,556 for a pressurized container in which the body of the valve is connected to an element having a continuous groove communicating with the interior chamber of the body of the valve, the groove being covered by a wall and defining a duct in the form of a capillary tube which communicates with the interior chamber of the body of the valve. This arrangement is extremely complicated and has not functioned satisfactorily.

The present invention has therefore as its object the novel commercial product which comprises a pressurized container equipped with at least one valve for the dispensing of a liquid product, said valve comprising a unique feed in passage which contains, upstream of the valve, a tubing section having a diameter less than 0.5 mm and sufficiently long, so that the liquid flow in the said tubing when the valve is open occurs at a REYNOLDS number less than 3000.

In a preferred embodiment, the inside diameter of the tubing section is between 0.1 and 0.3 mm; the length of the tubing section is between 75 and 500 times its inside diameter; the tubing section of small diameter is a hollow needle; the hollow needle is a hypodermic needle made of stainless steel; the needle is fixed to the inlet duct of the dispensing valve; the needle is placed essentially along the axis of the dispensing valve; the needle is substantially straight, and is disposed inside a plunger tube mounted on the inlet duct of the valve.

The above-mentioned preferred embodiment uses a length of a hypodermic needle. It can be established that the actual manufacturing tolerances of hypodermic needles permit the attainment of a very uniform and constant flow from pressurized containers according to the invention. It is important to note that, if the REYNOLDS number for flow inside the hypodermic needle is less than 2500, the quality of the flow depends very little on the length of the needle, which permits cutting the needle into sections with very low length tolerances without causing appreciable variations in the output obtained from container to container.

Considering the above, it is preferred to use the container according to the invention to dispense a pressurized liquid product by means of a non-liquified propellant gas such as compressed nitrogen, for example. The distributed product can be any substance, in particular, cosmetic products such as lacquers, perfumes or deodorants.

To better understand the purpose of the invention, but purely for purposes of illustration and not to be limiting, a preferred embodiment shown in the attached drawing will be described.

BRIEF DESCRIPTION OF THE DRAWINGS

Referring to FIG. 1, it can be seen that the container according to the invention is a spun aluminum can 1. Can 1 is made in a single piece and is closed at its upper part by a cup shaped valve-holder 2, whose central part retains a valve 3. The valve 3 comprises an outlet tube 4 on which a pushbutton (not shown) can be mounted, and an inlet tube 5 on which a flexible plunger tube 6 is fitted. Tube 6 is a tube of plastic material whose interior diameter is 3 mm. Container 1 encloses a liquid product 7 which is pressurized by compressed nitrogen at a pressure of 8 bars.

A straight section of a hypodermic needle 8 is force fitted into the inside passage of inlet duct 5 of valve 3. The hypodermic needle used has an inside diameter of 0.2 mm and is made of stainless steel. Container 1 has an interior volume of 315 $cm^3$; it is initially charged with 150 g of an alcoholic solution containing 94% ethanol and 6% hair resin. The viscosity of this solution at 20° C. is 3 cps.

Figure 1:
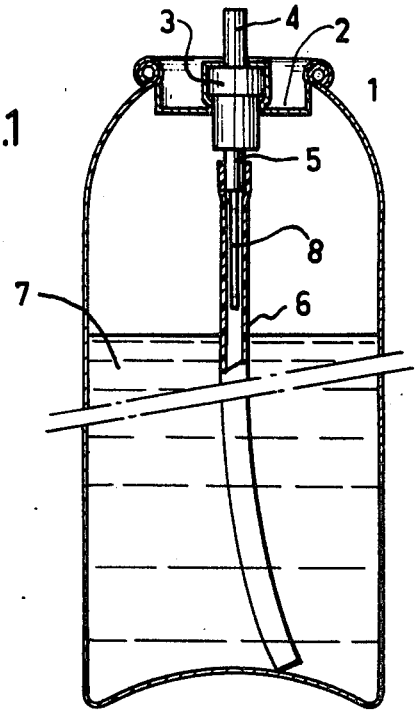
FIG. 1 shows a longitudinal view in section of a pressurized container according to the invention.
Figure 2:
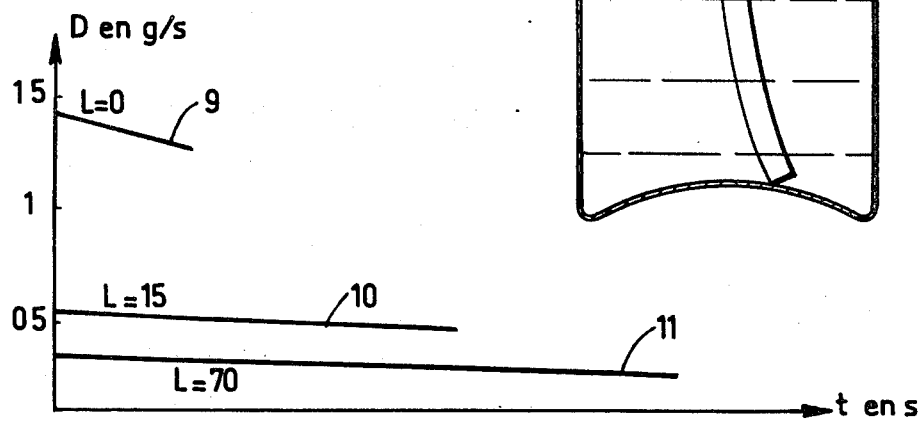
FIG. 2 is a graph which shows the dispensing curves for the container of FIG. 1.

In different experiments performed, the length L of the section of hypodermic needle 8 was varied and the effect of length variations on flow from the valve, expressed in g/second, was measured.

Where a container 1 with a valve 3 not equipped with a hypodermic needle was tested, the output curve 9 shown in FIG. 2 was obtained. It can be verified that the flow rate is variable as a function of time, that is, that it is much greater when the container is full than when the container is almost empty. Moreover, the flow rate of the dispensed product is quite high since valve 3 is a standard valve, normally used for the dispensing of a hair lacquer pressurized by liquified propellants such as chlorofluoralcanes. The usual substance flowing through the valve is 75% liquified propellant so that when the valve is used to dispense a liquid phase not containing propellant, the flow rate of active product is 4 times greater.

Figure 3:
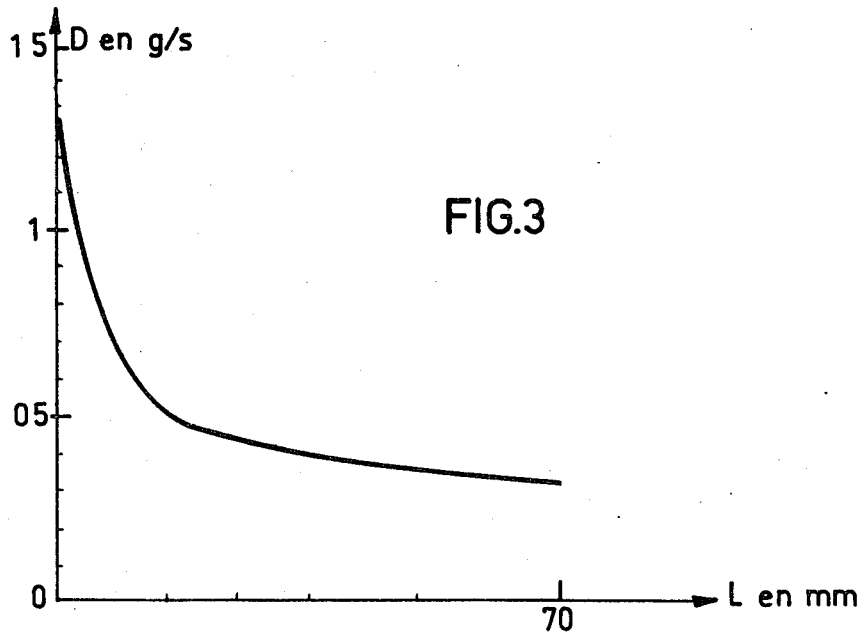
FIG. 3 shows on a graph the effect of the length of the hypodermic needle on the flow from the container of FIG. 1.

If a section of hypodermic needle 8 is connected to the inlet of valve 3, one obtains different results depending on the length of the section. It can be stated that, when the length of the section is greater than 15 mm, the dispensing flow rate of active product is practically constant from the start to the finish of the dispensing (for both a full and almost empty container). This characteristic can be observed from curves 10 and 11 of FIG. 2, which show flow rates, respectively, for needle sections of 15 mm and 70 mm in length. It would appear that the flow rate becomes more constant as the length of the needle section is increased. It would appear, also, that the flow rate varies only very little as a function of the length of the needle section, when this length is greater than about 15 mm. This fact is evident from the curve of FIG. 3 which shows the variation of flow, from the commencement of emptying the container, as a function of the length of the needle section. Being given that the length of section 8 has little effect on the flow rate obtained, it is clear that it is not necessary, to have reproducible outputs, to cut the needle sections into lengths with great precision.

It has been determined that the output obtained with a needle section with a length of 70 mm is about four times smaller than the output obtained with a valve 3 not equipped with a section of hypodermic needle. As a result one can use a container according to the invention equipped with a needle section of 70 mm to dispense the usual outputs of hair lacquer when pressurization is caused by a non-liquified gas such as nitrogen under pressure.

The results described above are for container 1 equipped with a needle 8 in the valve inlet and having an inside diameter or bore of 0.2 mm where flow is at a REYNOLDS number less than 3000. Similar results are obtained where the needle has a bore as large as about 0.5 mm. When a needle 8 with such a larger bore is used, the length of the needle is selected to provide the desired, essentially constant flow throughout dispensing from the container, at a REYNOLDS number less than 3000. Since needles of the hypodermic type have a very smooth bore, the desired laminar or only partly turbulent flow is readily obtained.

It is understood that the embodiment above described is in no way limiting and can be modified, without departing from the spirit of the invention.

What is claimed is:

1. A pressurized container equipped with at least one valve for dispensing a liquid product, said valve having an inlet duct, and a supply system for feeding the liquid product to the valve comprising, a hollow needle fixed to the inlet duct of the valve, said needle having an inside diameter less than 0.5 mm, and a length between 75 and 500 times its inside diameter, said needle being essentially straight and disposed within a feed tube fitted onto the inlet duct of the valve, so that during dispensing when the valve is open flow occurs at a REYNOLDS number less than 3000.

2. Container according to claim 1, containing a liquid product pressurized by a non-liquified compressed propellant gas.

3. Container according to claim 1, in which the inside diameter of the tubing section is between 0.1 and 0.3 mm.

4. Container according to claim 1, in which the hollow needle is a stainless steel hypodermic needle.

5. Container according to claim 1, in which the needle is positioned essentially along the axis of the dispensing valve.

6. Container according to claim 1, in which the contained liquid product to be dispensed comprises a cosmetic product selected from the group consisting of hair laquer, perfume or deodorant.

* * * * *